US005257827A

United States Patent [19]

Takeuchi et al.

[11] Patent Number: 5,257,827

[45] Date of Patent: Nov. 2, 1993

[54] SPRINKLER HEAD

[75] Inventors: Takashi Takeuchi, Kanagawa; Teturou Kikuchi, Iwate, both of Japan

[73] Assignee: Senju Sprinkler Company Limited, Tokyo, Japan

[21] Appl. No.: 730,117

[22] Filed: Jul. 15, 1991

[30] Foreign Application Priority Data

Jul. 16, 1990 [JP] Japan ..... 2-74403[U]
Sep. 4, 1990 [JP] Japan ..... 2-92450[U]

[51] Int. Cl.[5] ..... A62C 37/10
[52] U.S. Cl. ..... 169/41
[58] Field of Search ..... 169/37, 38, 41

[56] References Cited

U.S. PATENT DOCUMENTS 2,528,063 10/1950 Loepsinger ..... 169/38
4,108,247 8/1978 Mohler ..... 169/38
4,511,003 4/1985 Randall ..... 169/38

FOREIGN PATENT DOCUMENTS 650410 11/1964 Belgium ..... 169/37
304958 7/1971 U.S.S.R. ..... 169/37

*Primary Examiner*—David M. Mitchell
*Assistant Examiner*—Gary C. Hoge
*Attorney, Agent, or Firm*—Tarolli, Sundheim & Covell

[57] ABSTRACT

A frame-type sprinkler head for dispensing fire extinguishing liquid. The sprinkler head includes a frame having a conducting hole therein through which fire extinguishing liquid may flow. The sprinkler head includes a valve body disposed adjacent to the conducting hole for blocking the conducting hole. The sprinkler head including a packing affixed to the valve body to prevent separation of the packing and the valve body. The packing is disposed between the conducting hole and the valve body for preventing leakage of the extinguishing liquid past the valve body. The sprinkler head includes a band-like protrusion extending from an edge of the packing. The band-like protrusion is engaged with an engagement portion provided on the frame for causing pivoting movement of said valve body and for preventing lodgement.

3 Claims, 3 Drawing Sheets

SPRINKLER HEAD

BACKGROUND OF THE INVENTION

1. Field of the Invention

The present invention relates generally to a sprinkler head on which a lodgement preventive measure is effected among the sprinkler heads for extinguishing a fire, and more particularly, to a sprinkler head which includes a packing engaged with a frame, for preventing the lodgement.

2. Description of the Prior Art

In the sprinkler head having a horse-shoe-shaped arm, as illustrated in FIG. 7, a valve body 30 is knocked straight down by an extinguishing liquid spurting out during an operation. In some cases, the valve body 30 or other parts may lodge on a boss 14. This phenomenon is known as a lodgement. If the lodgement takes place in the sprinkler head when the fire occurs, the extinguishing liquid, which is originally sprinkled uniformly by a deflector, is sprinkled in irregular directions through the valve body. Thus, normal fire-extinguishing activity can not be performed. It is an ironclad rule that lodgement should be avoided in the sprinkler head.

A multiplicity of sprinkler heads on which the lodgement preventive measures are effected have hitherto been proposed. (See: Japanese Utility Model Publication Nos. 10698/1982, 52456/1982 and Japanese Utility Model Laid-Open Nos. 26660/1984, 102053/1984, 159455/1984, 151750/1986.

Those sprinkler heads for preventing the lodgement all exhibit the lodgement preventive effects. In the sprinkler head in which the valve body is machined, however, it is difficult to machine a hard valve body. This presents problems in terms of machining accuracy and prices. On the other hand, the sprinkler heads in which the packing is machined have such characteristics that there is no problem in accuracy because of such thin, soft packing as compared with the sprinkler head including the machined valve, and the packing is easy to machine. Namely, among the lodgement preventive sprinkler heads, the sprinkler head disclosed in Japanese Utility Model Publication No. 42456/1982 is the most excellent one in terms of manufacturing and price, wherein the packing engages with a frame (hereinafter referred as a packing engagement type).

It is a rare case that the lodgement is caused even in the sprinkler head on which no lodgement preventive measure is effected generally when being attached to a pipe. Besides, there is almost no possibility of causing the lodgement in the packing engagement type. When performing an experiment for the occurrence of lodgement under conditions favable to such a lodgement, the lodgement, though very slight, may take place even in the packing engagement type sprinkler head. The sprinkler head is not allowed to cause the lodgement even during the experiment, because this implies its possibility in the practical use.

SUMMARY OF THE INVENTION

It is a primary object of the present invention to provide the improvement of a packing engagement type sprinkler head which is superior in terms of manufacturing and price, wherein a lodgement does not take place even during experimentation.

The present inventors researched the causes for the occurrence of lodgement in the packing engagement type sprinkler head through a very-high-speed VTR and found out the following. A decomposition part is at first decomposed due to the heat and scattered outside the sprinkler head. Subsequently, a valve body and a packing drop down after being unseated from a frame by an extinguishing liquid spurting out of the frame. At this moment, the valve body drops down in advance of the packing, and hence only the valve body rides on a boss and undergoes a uniform impingement of the extinguishing liquid spurting out. As a result, the lodgement is caused.

The present inventors completed this invention, paying attention to the fact that the lodgement is not caused if the valve body does not drop down in advance.

To accomplish the foregoing object, according to one aspect of the invention, there is provided a frame type sprinkler head having an arm, characterized in that a band-like protrusion is formed on a part of packing, the top end of said protrusion engages with an engagement portion provided on a frame, and said packing is fixed to a valve body.

According to the present invention, as a means for fixing the valve body to the packing, the valve body is held by a part of the packing, or alternatively the valve body is bonded to the packing with a bonding agent.

BRIEF DESCRIPTION OF THE DRAWINGS

Other objects and advantages of the present invention will become apparent during the following discussion taken in conjunction with the accompanying drawings, in which.

DETAILED DESCRIPTION OF THE PREFERRED EMBODIMENTS

Figure 1:
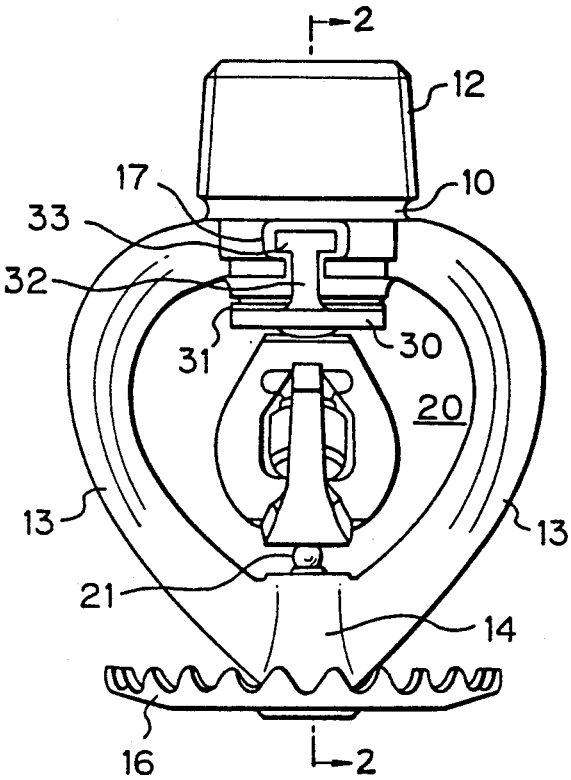
FIG. 1 is a front elevation depicting a sprinkler head of this invention.
Figure 2:
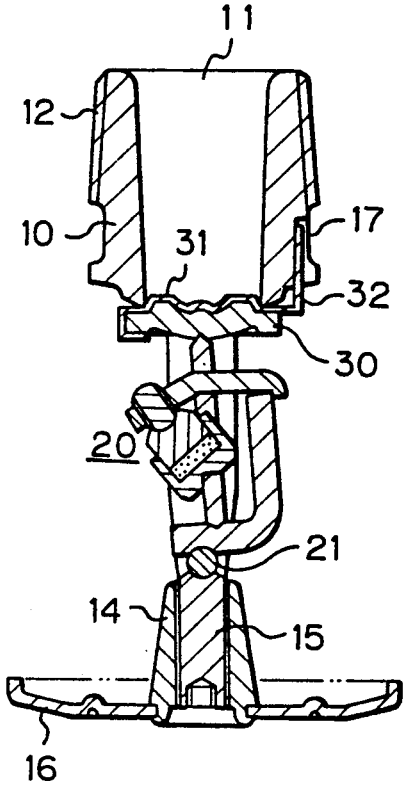
FIG. 2 is a sectional view taken substantially along the line 2—2 of FIG. 1.
Figure 3:
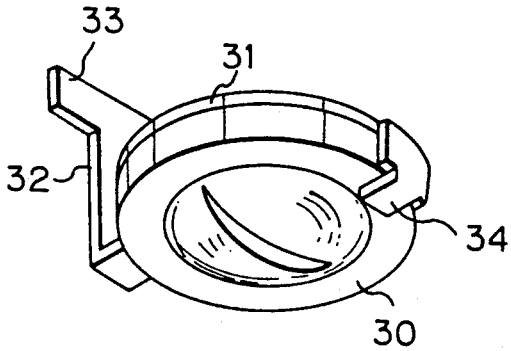
FIG. 3 is an enlarged perspective view illustrating the principal portion of a first embodiment of the present invention.
Figure 4:
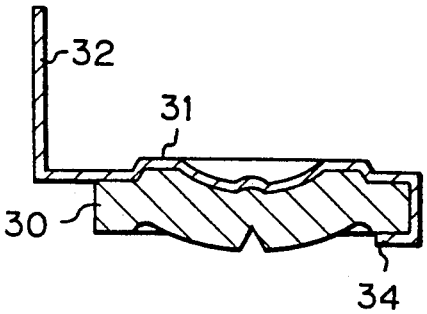
FIG. 4 is a central front view in section thereof.

FIG. 1 is a front elevation illustrating a sprinkler head according to the present invention. FIG. 2 is a sectional view taken substantially along the line 2—2 of FIG. 1. FIG. 3 is an enlarged perspective view depicting the principal portion of this invention. FIG. 4 is a front elevation in section thereof.

A frame 10 is provided inwards with a conduit hole 11 and outwards with a pipe thread 12 connected to a system pipe. A pair of arms 13, 13 extend downwards to assume a horse-shoe shape. An intersection of the arms 13, 13 serves as a boss 14 formed integrally therewith. A fastening screw 15 having a recess at its top is screwed into the boss 14. A ball 21 for pivot-retaining a decomposition part 20 is fitted in the recess. A deflector 16 having a plurality of blades is provided at the lower end of the boss 14.

A valve body 30 is fitted through a packing 31 in a conduit outlet formed at the lower end of the frame 10. The decomposition part 20 is disposed between the valve body 30 and the fastening screw 15. This decomposition part has a known construction and is not the principal component. Hence, the description thereof is omitted.

The packing 31 is formed with a protrusion 32 extending in a band-like configuration. The top end of the protrusion serves as a T-shaped part 33 having a larger width. As illustrated in FIGS. 2 through 4, the packing 31 is formed with a band-like second protrusion 34 extending opposite to the protrusion 32. The protrusion 34 is bent along the valve body from the surface thereof and holds the rear face of the valve body.

The T-shaped part 33 of the packing 31 is detachably fitted to an engagement part 17 recessed in the side surface of the frame 10. The engagement part 17 is a T-shaped groove adaptive to an easy insertion of the T-shaped part 33.

The T-shaped part 33 engages with the engaging portion 17 so that the valve body is moved sideway when water is discharged from the conducting hole upon the occurrence of fire.

Figure 6:
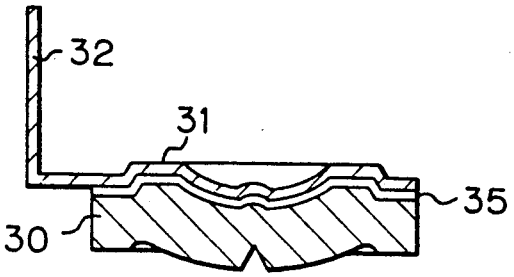
FIG. 6 is an enlarged central front view in section showing the principal portion of a second embodiment of this invention.

FIG. 6 is an enlarged sectional view illustrating the principal portion of another embodiment of the present invention. The valve body 30 is fixed to the packing with a bonding agent 35.

The operation of the sprinkler head of this invention will next be explained.

Figure 5:
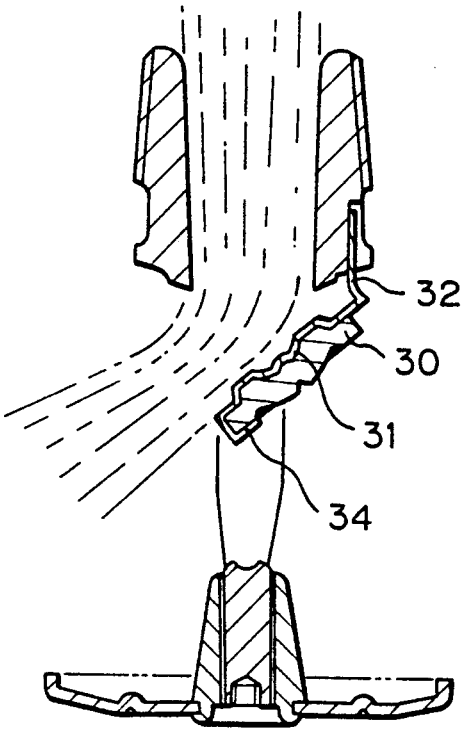
FIG. 5 is a view of assistance in explaining an operating state of the sprinkler head of this invention.
Figure 7:
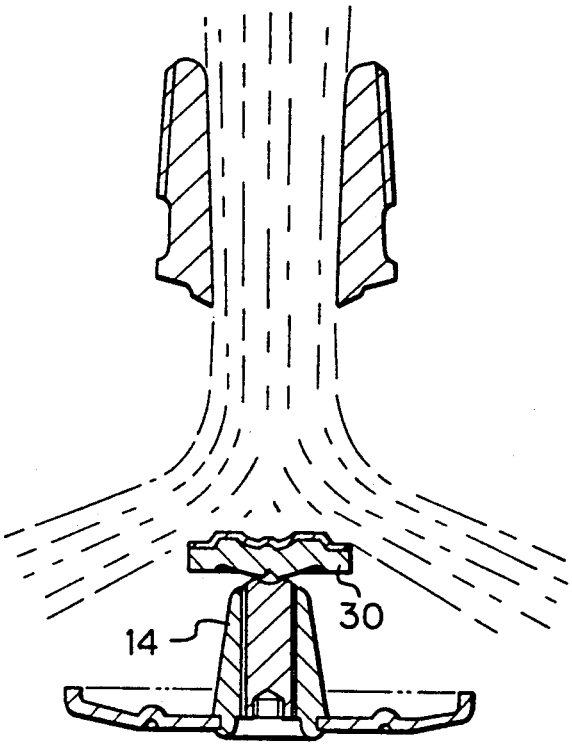
Fig. 7 PRIOR ART
FIG. 7 is a view of assistance in explaining a lodgement in the sprinkler head.

Upon the occurrence of a fire, the decomposition part 20 is decomposed due to the abnormally high temperatures of the fire. At the same moment, the valve body 30 retained by the decomposition part opens the conduit hole 11. At this time, the packing 31 is fixed to the valve body 30. The T-shaped part 33 of the packing engages with the frame 10 and is therefore, as illustrated in FIG. 5, swayed sideways without separating from the valve body. The decomposition part is scattered outwardly from the frame due to the motion of the valve. Hence, the valve body does not singly drop straight down. The decomposition part does not cause the lodgement on the boss at all. Engagement of the band-like protrusion with the frame is constructed so that the valve body 30 does not vertically fall when water flows out from the conduit hole 11. In other words, upon the occurrence of fire, the valve body is moved sideward of the sprinkler as shown in FIG. 5. This prevents the valve body 30 from riding on the boss 14 (as shown in FIG. 7). Even when the valve body and the packing remain engaged with the frame, however, these components are not aligned with the passageway of the extinguishing liquid flowing out of the conduit hole. This does not hinder the sprinkling of the extinguishing liquid.

According to the present invention, in the packing stopping type sprinkler head, the valve body is fixed to the packing. This arrangement completely eliminates the lodgement which takes place in the conventional packing stopping type sprinkler head in an extremely rare case. The present invention further improves the reliability.

Although the illustrative embodiments have been described in detail with reference to the accompanying drawings, it is to be understood that the present invention is not limited to those embodiments. Various changes or modifications may be effected therein by one skilled in the art without departing from the scope or spirit of the invention.

What is claimed is:

1. A frame-type sprinkler head for dispensing fire extinguishing liquid, said sprinkler head comprising:

a frame having a conducting hole therein through which fire extinguishing liquid may flow;

a valve body disposed adjacent to said conducting hole for blocking said conducting hole;

a packing fixed to said valve body for preventing separation of said packing and said valve body, said packing being disposed between said conducting hole and said valve body for preventing leakage of the extinguishing liquid past said valve body;

a band-like protrusion being engaged with an engagement portion provided in said frame for causing pivoting movement of said valve body and for preventing lodgement; and a second band-like protrusion being provided on the packing to extend from an edge of said packing along the edge of said valve body to a bottom face of said valve body so that said packing is fixed to said valve body.

2. A sprinkler head for dispensing fire extinguishing liquid, said sprinkler head comprising:

a frame with a conduit through which fire extinguishing liquid may flow, said frame having surface means defining a terminus of said conduit;

a deflection member aligned to receive a flow of fire extinguishing liquid from said conduit for dispersing the fire extinguishing liquid over an area;

a valve member aligned between said conduit and said deflector member and adjacent to said surface means defining the terminus of said conduit for blocking said conduit; and a packing member fixed to said valve member, said packing member being located between said surface means defining the terminus of said conduit and said valve member for preventing leakage of the extinguishing liquid from said conduit past said valve member; said packing member having a flat protrusion connected at one end to said frame to permit deflection of said protrusion and pivoting of said valve member and said packing member relative to said frame and said deflector member and away from said surface means defining the terminus of said conduit to permit flow of the extinguishing liquid from said conduit and to move said valve member to a location to prevent lodgement of said valve member on said deflection member.

3. A sprinkler head as set forth in claim 2, wherein said packing member includes a portion which extends partially about said valve member and engages a surface of said valve member positioned away from said surface means of said frame which defines the terminus of said conduit and toward said deflection member for holding said valve member to prevent separation of said valve member from said packing member.

* * * * *